US011324251B2

(12) United States Patent
He

(10) Patent No.: US 11,324,251 B2
(45) Date of Patent: May 10, 2022

(54) AROMATIC BEAD FEEDER FOR CIGARETTE FILTERS

(71) Applicant: GUANGDONG AILBOO BIOTECHNOLOGY CO., LTD., Dongguan (CN)

(72) Inventor: Wentian He, Dongguan (CN)

(73) Assignee: GUANGDONG AILBOO BIOTECHNOLOGY CO., LTD., Dongguan (CN)

( * ) Notice: Subject to any disclaimer, the term of this patent is extended or adjusted under 35 U.S.C. 154(b) by 442 days.

(21) Appl. No.: 16/541,226

(22) Filed: Aug. 15, 2019

(65) Prior Publication Data

US 2019/0364958 A1 Dec. 5, 2019

Related U.S. Application Data

(63) Continuation of application No. PCT/CN2017/079334, filed on Apr. 1, 2017.

(30) Foreign Application Priority Data

Feb. 17, 2017 (CN) ..... 201710085987.5

(51) Int. Cl.
*A24D 3/02* (2006.01)
*A24D 3/06* (2006.01)
(Continued)

(52) U.S. Cl.
CPC ..... *A24D 3/0216* (2013.01); *A24D 3/061* (2013.01); *B65D 83/00* (2013.01); *A24D 3/048* (2013.01); *B65D 85/58* (2013.01); *B65D 2583/00* (2013.01)

(58) Field of Classification Search
CPC .. A24D 3/0216; B65D 83/04; B65D 83/0481; B65D 2583/0431; B65D 2583/045
See application file for complete search history.

(56) References Cited

U.S. PATENT DOCUMENTS 3,968,902 A * 7/1976 Bachmann ..... B65D 83/0409 221/263
2006/0157075 A1 7/2006 Gauthier

FOREIGN PATENT DOCUMENTS

CN 102573531 A 7/2012
CN 103010776 A 4/2013
(Continued)

OTHER PUBLICATIONS

International Search Report in counterpart PCT international application PCT/CN2017/079334.
(Continued)

*Primary Examiner* — Eric Yaary

(57) ABSTRACT

An aromatic bead feeder for cigarette filters, comprising a conical part (1) and a push rod (2) directly or indirectly connected with the conical part. The conical part includes a front cone part (11) and a rear extension part (12). The conical part and the push rod are indirectly connected into a whole through a connection part and are respectively located at two ends of the connection part or located at one end of the connection part. The connection part is an accommodating part (4) provided with an accommodating cavity and an aromatic bead outlet (41), and a cover (42) capable of being opened or closed is arranged at the aromatic bead outlet (41). The cylindrical positioning sleeves (7) matched with cigarette filters are arranged outside the conical part and the push rod.

17 Claims, 5 Drawing Sheets

(51) Int. Cl.

| | |
|---|---|
| ***B65D 83/00*** | (2006.01) |
| *A24D 3/04* | (2006.01) |
| *B65D 85/58* | (2006.01) |

(56) References Cited

FOREIGN PATENT DOCUMENTS

| | | | |
|---|---|---|---|
| CN | 103099313 | A | 5/2013 |
| CN | 103917114 | A | 7/2014 |
| CN | 105495692 | A | 4/2016 |
| WO | 2009071643 | A2 | 6/2009 |
| WO | 2011116978 | | 9/2011 |

OTHER PUBLICATIONS

First Office Action in counterpart Chinese application 201710085987.
5.
Second Office Action in counterpart Chinese application 201710085987.
5.
Third Office Action in counterpart Chinese application 201710085987.
5.

* cited by examiner

AROMATIC BEAD FEEDER FOR CIGARETTE FILTERS

TECHNICAL FIELD

The invention relates to smoking tools, in particular to an aromatic bead feeder for cigarette filters.

DESCRIPTION OF RELATED ART

Generally, existing cigarette filters have the only function of filtering out dust particles in cigarettes. To diversify the fragrances of cigarettes, a soft capsule used for capsulizing liquid perfumes is placed into the cigarette filters to generate various pleasant fragrances such as a lemon fragrance, a hibiscus fragrance, and a jasmine fragrance. Different liquid perfumes are capsulized in different soft capsules. If the smokers dislike certain fragrances, they can avoid squeezing the soft capsules corresponding to these fragrances in the cigarette filters when smoking. If the smokers like certain fragrances, they can forcibly press the cigarette filters with their fingers to crush the soft perfume capsules corresponding to these fragrances in the cigarette filters when smoking, so that the whole cigarette filters will be full of the liquid perfumes in the soft capsules. In this way, the fragrances of the perfumes suffuse the space around to create a fragrant environment. An existing method for making these soft perfume capsules, which are called aromatic beads herein, is implemented as follows: when cigarettes are produced in a cigarette factory, the aromatic beads are directly placed into sponges of the filters and are then curled to obtain finished cigarettes. In this way, the smokers can conveniently crush or not crush the aromatic beads when smoking. However, the smokers cannot select the fragrances of the aromatic beads due to the fact that the aromatic beads have already been placed into the sponges of the cigarette filters when leaving the factory; and due to the fact that the aromatic beads are placed in the sponges of the cigarette filters, the smokers cannot reserve the aromatic beads regardless of whether or not the aromatic beads have been effectively used and have to discard them when the cigarettes are exhausted even if these aromatic beads have not been used yet. In view of this, it is necessary to develop a novel tool for producing cigarettes provided with aromatic beads to overcome these above-mentioned defects of the aromatic beads for cigarettes in use.

To overcome the defects of the prior art, the objective of the invention is to provide an aromatic bead feeder for cigarette filters to allow smokers to voluntarily place aromatic beads having different fragrances into the cigarette filters or not to place aromatic beads into the cigarette filters, so that the aromatic beads are effectively used without being wasted.

The technical solution adopted by the invention to settle the technical issues is as follows: an aromatic bead feeder for cigarette filters includes a conical part and a push rod directly or indirectly connected with the conical part.

Preferably, the conical part includes a front cone part and a rear extension part.

Preferably, the end surface of the push rod is a plane or a concave arc surface.

Preferably, the conical part and the push rod are directly and oppositely connected.

Preferably, the conical part and the push rod are indirectly connected into a whole through a connection part and are respectively located at two ends of the connection part or located at one end of the connection part.

Preferably, the connection part is an accommodating part provided with an accommodating cavity and an aromatic bead outlet, and a cover capable of being opened or closed is arranged at the aromatic bead outlet.

Preferably, a magnetic sheet is arranged at one internal end of the accommodating part, or magnetic sheets are arranged at two internal ends of the accommodating part.

Preferably, the accommodating part is a circular tube, the cover capable of being opened or closed is a rotatable sleeve ring arranged on the circular tube and located at the aromatic bead outlet, and a through hole capable of being rotated to correspond to the aromatic bead outlet is formed in the sleeve ring.

Preferably, the accommodating part is a square tube, and the cover capable of being opened or closed is a slidable cover plate arranged on the square tube and located at the aromatic bead outlet.

Preferably, the connection part is a chain or a connection block.

Preferably, cylindrical positioning sleeves matched with cigarette filters are arranged outside the conical part and the push rod, or a cylindrical positioning sleeve matched with the cigarette filters is arranged outside the conical part or the push rod.

Preferably, an aromatic bead positioning ring is arranged in the cylindrical positioning sleeve outside the push rod, has a middle provided with an aromatic bead accommodating hole, and is able to slide forwards and backwards in the cylindrical positioning sleeve, and the push rod is able to stretch into the aromatic bead accommodating hole.

Preferably, a compression spring is arranged on the internal side of the aromatic bead positioning ring and abuts against the internal bottom of the cylindrical positioning sleeve.

Preferably, a clamping point is arranged at the external edge of the aromatic bead positioning ring, and a clamping ring corresponding to the clamping point is arranged at the end of the cylindrical positioning sleeve.

Preferably, a stop ring is arranged in the internal middle of the aromatic bead accommodating hole, and a baffle ring corresponding to the stop ring is arranged at the end of the push rod.

The invention has the following beneficial effects: as the aromatic bead feeder for cigarette filters includes the conical part and the push rod directly or indirectly connected with the conical part, the conical part of the aromatic bead feeder for cigarette filters punches a conical hole in the center of the tail of a cigarette first, then the push rod is inserted into the cigarette filter via the conical hole and is then pulled out to form an aromatic bead inlet, and afterwards, an aromatic bead is placed into the conical hole and is sustained and pushed inwards by the push rod to be fed into the cigarette filter; after the aromatic bead is fed into the cigarette filter, the conical hole contracts under the effect of the soft and elastic cigarette filter made of sponge materials, so that the aromatic bead will not leak out, and the appearance of the tail of the cigarette filter is hardly affected. Thus, by adoption of the aromatic bead feeder for cigarette filters, smokers can voluntarily place aromatic beads having different fragrances into cigarette filters more conveniently or not place aromatic beads into the cigarette filters, thereby being more convenient to use and meeting temporary requirements of the smokers. Besides, the aromatic beads will not be placed into the cigarette filters when not needed, so that aromatic beads are effectively used, and waste of the aromatic beads is avoided.

BRIEF DESCRIPTION OF THE SEVERAL VIEWS OF THE DRAWINGS

The invention is further expounded as follows in combination with the accompanying drawings and implementations.

DETAILED DESCRIPTION OF THE INVENTION

Figure 1:
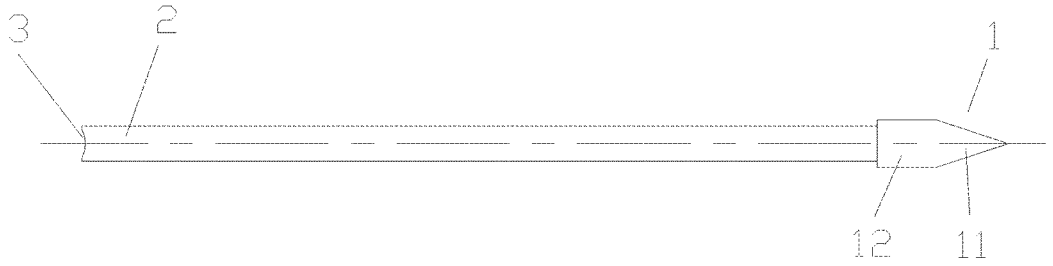
FIG. 1 is a structural view of Embodiment 1 of the invention.
Figure 2:
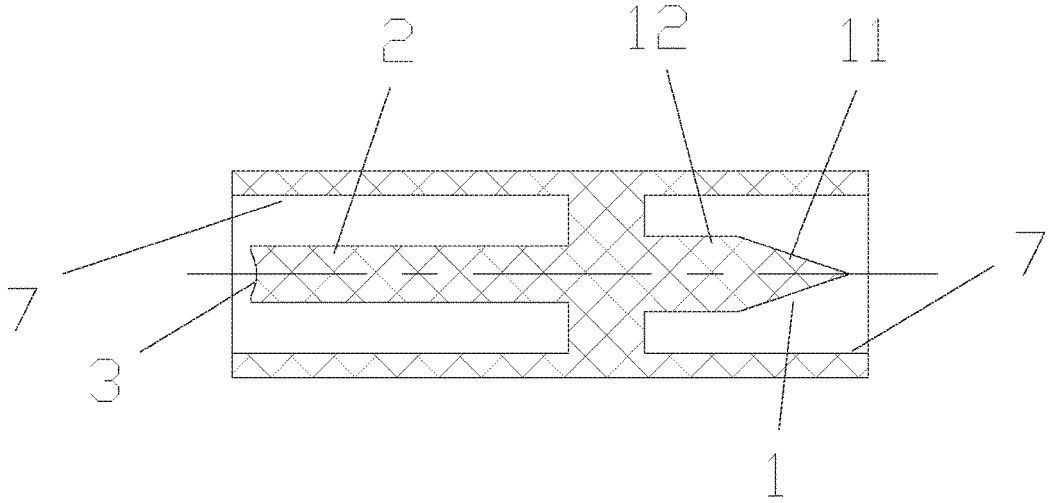
FIG. 2 is a sectional view of Embodiment 2 of the invention.

Referring to FIG. 1 to FIG. 10, an aromatic bead feeder for cigarette filters includes a conical part 1 and a push rod 2 directly or indirectly connected with the conical part. The conical part of the aromatic bead feeder for cigarette filters punches a conical hole in the center of the tail of a cigarette filter first, then the push rod is inserted into the cigarette filter via the conical hole and is then pulled out to form an aromatic bead inlet, and afterwards, an aromatic bead is placed into the conical hole and is sustained and pushed inwards by the push rod to be fed into the cigarette filter; after the aromatic bead is fed into the cigarette filter, the conical hole contracts under the effect of the soft and elastic cigarette filter made of sponge materials, so that the aromatic bead will not leak out, and the appearance of the tail of the cigarette filter is hardly affected. Smokers can voluntarily place aromatic beads with any fragrances into cigarette filters or not place aromatic beads into the cigarette filter, so that using is more convenient, and waste of aromatic beads is avoided.

In a preferred solution, the conical part includes a front cone part 11 and a rear extension part 12, wherein the cone part is to be inserted into the conical hole, and the extension part can be in any proper shape. The end surface 3 of the push rod is a plane or a concave arc surface allowing the aromatic bead to be inserted therein.

In a preferred solution, the conical part and the push rod are directly and oppositely connected, as shown in FIG. 1. This embodiment has a simple structure and a low cost.

Figure 3:
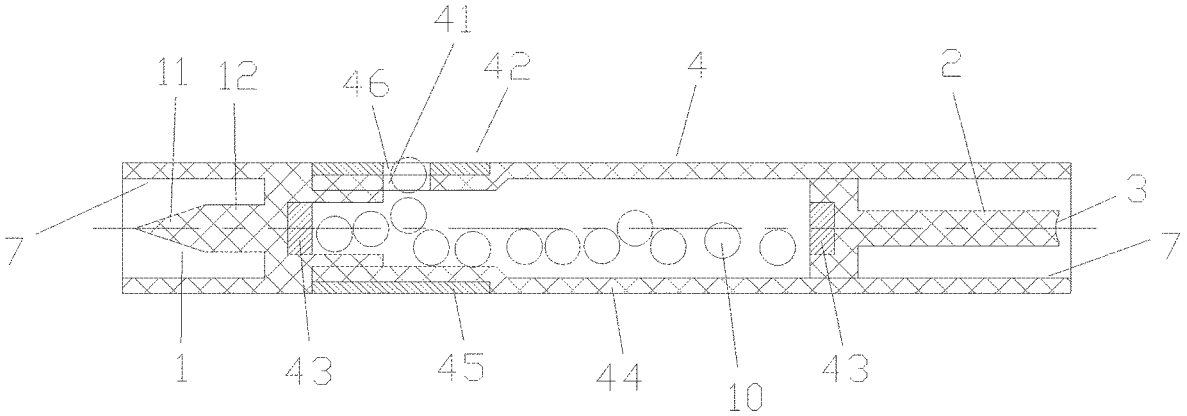
FIG. 3 is a sectional view of Embodiment 3 of the invention.

In a preferred solution, the conical part and the push rod are indirectly connected into a whole through a connection part and are respectively located at two ends of the connection part or located at one end of the connection part. As shown in FIG. 3, the connection part is an accommodating part 4 provided with an accommodating cavity and an aromatic bead outlet 41, and a cover 42 capable of being opened or closed is arranged at the aromatic bead outlet. A plurality of aromatic beads 10 are stored in the accommodating part and can be taken out via the aromatic bead outlet, and the cover 42 is closed when the aromatic bead feeder is not used. In a preferred solution, a magnetic sheet 43 is arranged at one internal end of the accommodating part, or magnetic sheets 43 are arranged at two internal ends of the accommodating part. The magnetic sheet(s) can retain the quality and freshness of the liquid aromatic beads in the accommodating part, thereby being good for health.

Figure 9:
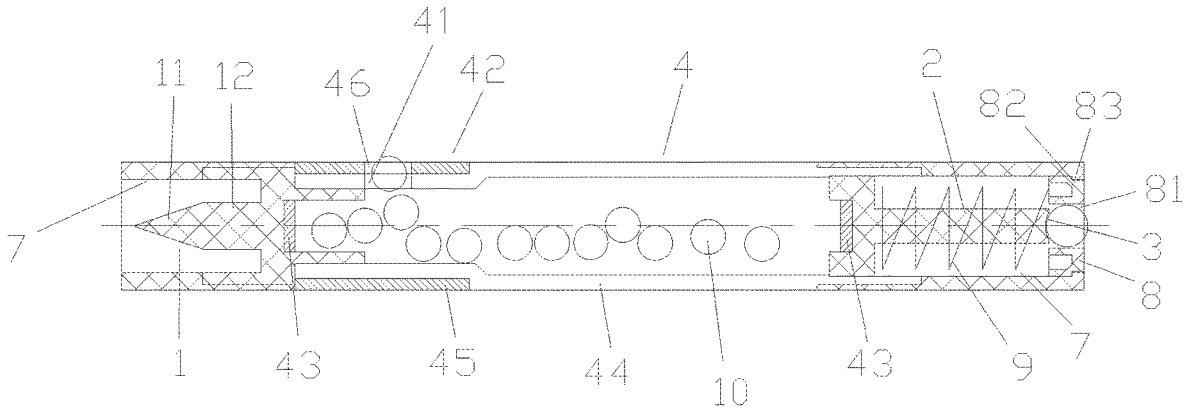
FIG. 9 is a sectional view of Embodiment 9 of the invention.

In a preferred solution, the accommodating part is a circular tube 44, the cover capable of being opened or closed is a rotatable sleeve ring 45 arranged on the circular tube and located at the aromatic bead outlet, and a through hole 46 capable of being rotated to correspond to the aromatic bead outlet is formed in the sleeve ring, as shown in FIG. 3 and FIG. 9.

Figure 8:
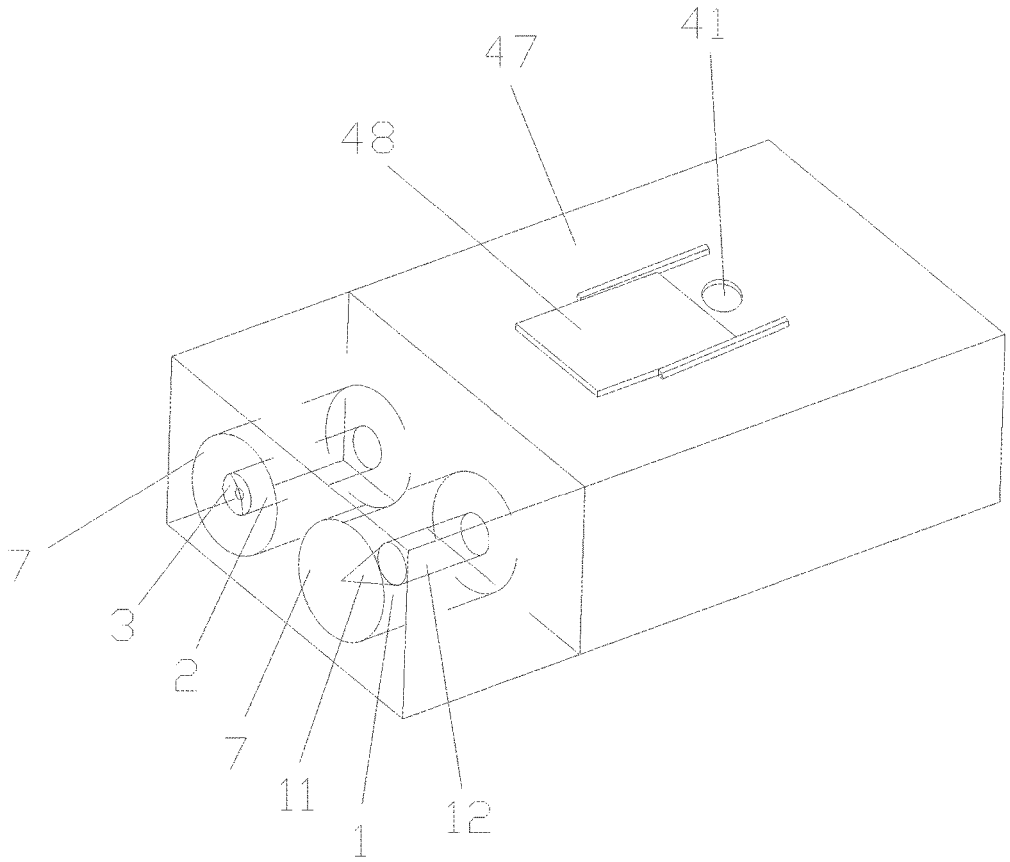
FIG. 8 is a perspective view of Embodiment 8 of the invention.

In a preferred solution, the accommodating part is a square tube 47, and the cover capable of being opened or closed is a slidable cover plate 48 arranged on the square tube and located at the aromatic bead outlet, as shown in FIG. 8. The accommodating part provided with the accommodating cavity can also be in an animal shape such as a tiger shape, a snake shape, or other special shapes.

Figure 4:
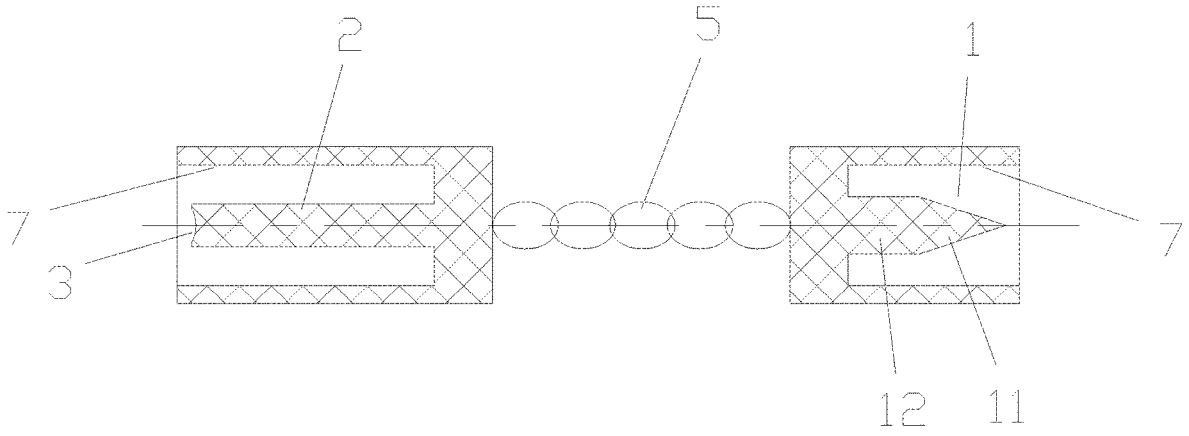
FIG. 4 is a sectional view of Embodiment 4 of the invention.
Figure 5:
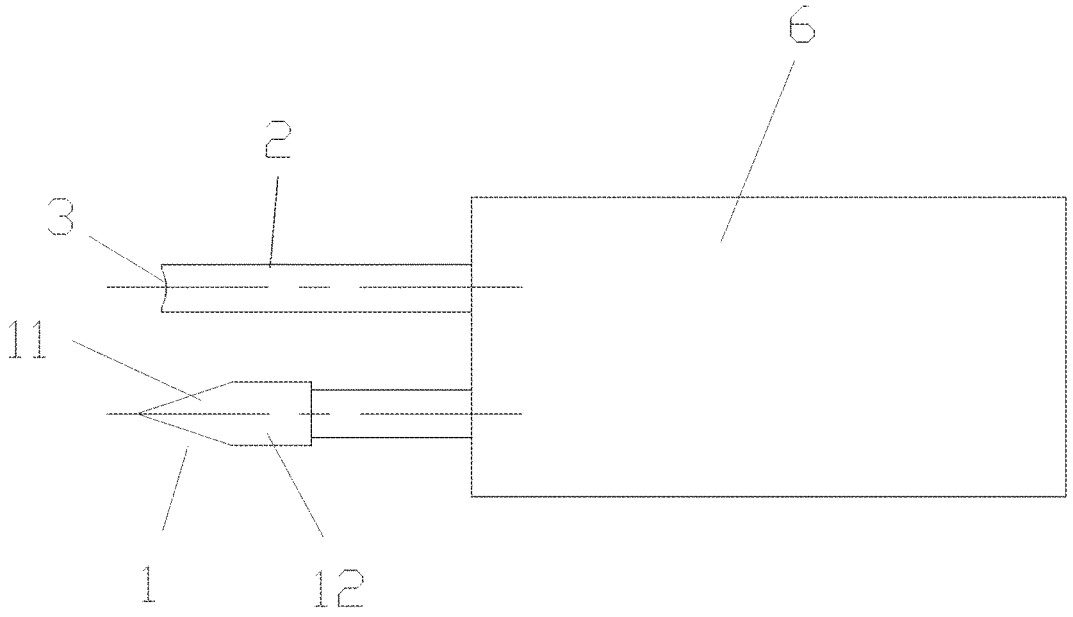
FIG. 5 is a structural view of Embodiment 5 of the invention.
Figure 6:
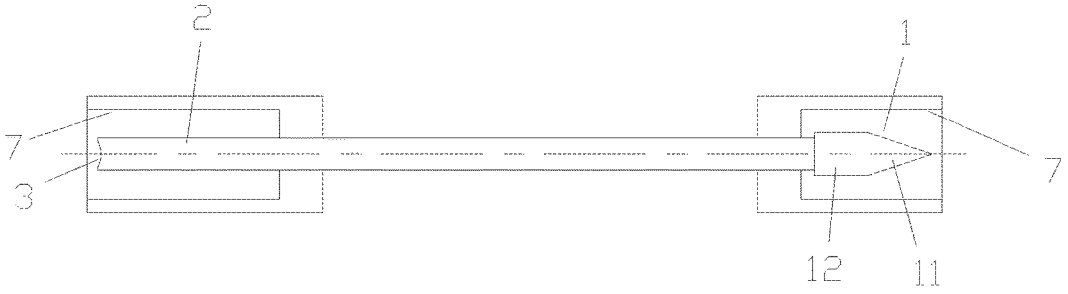
FIG. 6 is a structural view of Embodiment 6 of the invention.
Figure 7:
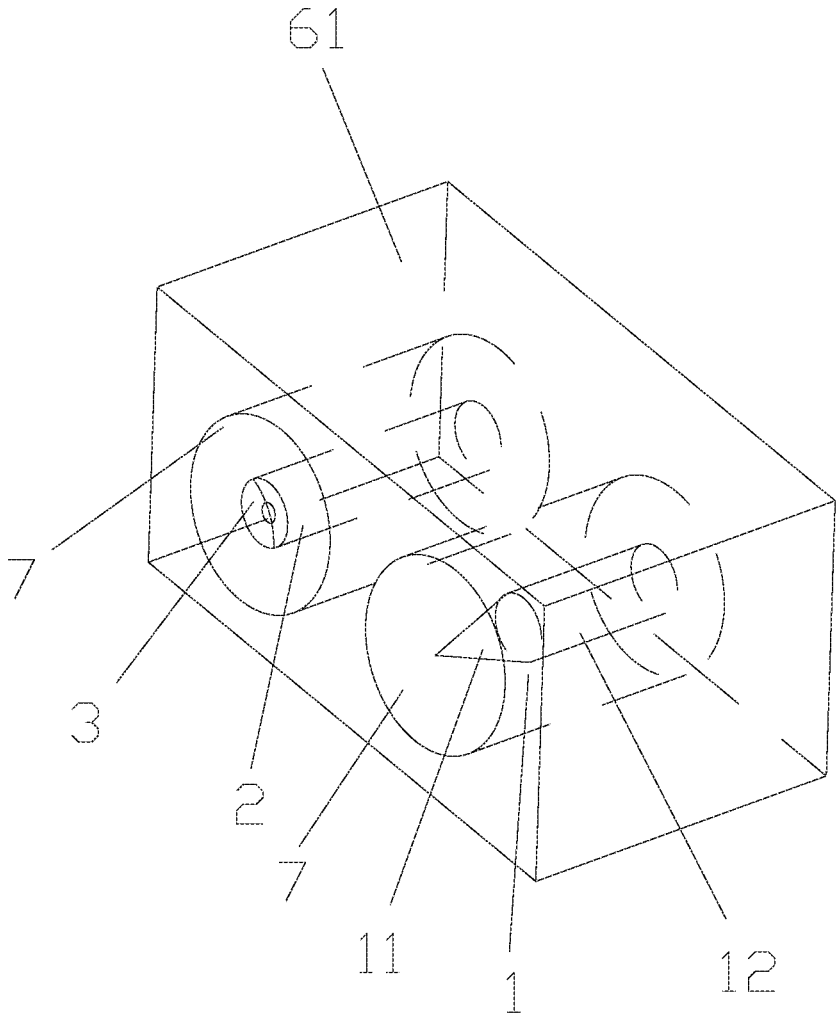
FIG. 7 is a perspective view of Embodiment 7 of the invention.

In a preferred embodiment, the connection part is a chain 5 (as shown in FIG. 4) or a connection block 6 (as shown in FIG. 5). FIG. 7 shows the connection block in another form, namely a connection block II 61. The connection part is formed by two magnets or two magnetic sheets, and the conical part 1 and the push rod 2 are attracted by means of attractive forces of the magnets or the magnetic sheets to be connected together and can also be separated for use.

In a preferred solution, cylindrical positioning sleeves 7 matched with cigarette filters are arranged outside the conical part and the push rod; or, a cylindrical positioning sleeve 7 matched with the cigarette filters is arranged outside the conical part or the push rod. When the push rod is inserted into the conical hole or pushes the aromatic beads into the conical hole, the positioning sleeve has positioning and smoothing effects, so that misalignment is avoided.

In a preferred solution, as shown in FIG. 9, an aromatic bead positioning ring 8 is arranged in the cylindrical positioning sleeve outside the push rod, has a middle provided with an aromatic bead accommodating hole 81, and is able to slide forwards and backwards in the cylindrical positioning sleeve, and the push rod is able to stretch into the aromatic bead accommodating hole. When the aromatic beads are pushed in by the push rod, the aromatic bead positioning ring stabilizes the aromatic beads to prevent accidental falling of the aromatic beads. A compression spring 9 is arranged on the internal side of the aromatic bead positioning ring and abuts against the internal bottom of the cylindrical positioning sleeve. A clamping point 82 is arranged at the external edge of the aromatic bead positioning ring, a clamping ring 83 corresponding to the clamping point is arranged at the end of the cylindrical positioning sleeve, the clamping point and the clamping ring prevent the aromatic bead positioning ring from being pushed out of the cylindrical positioning sleeve by the compression spring, and the aromatic bead positioning ring is compressed to retreat to the bottom of the cylindrical positioning sleeve when one aromatic bead is fed.

Figure 10:
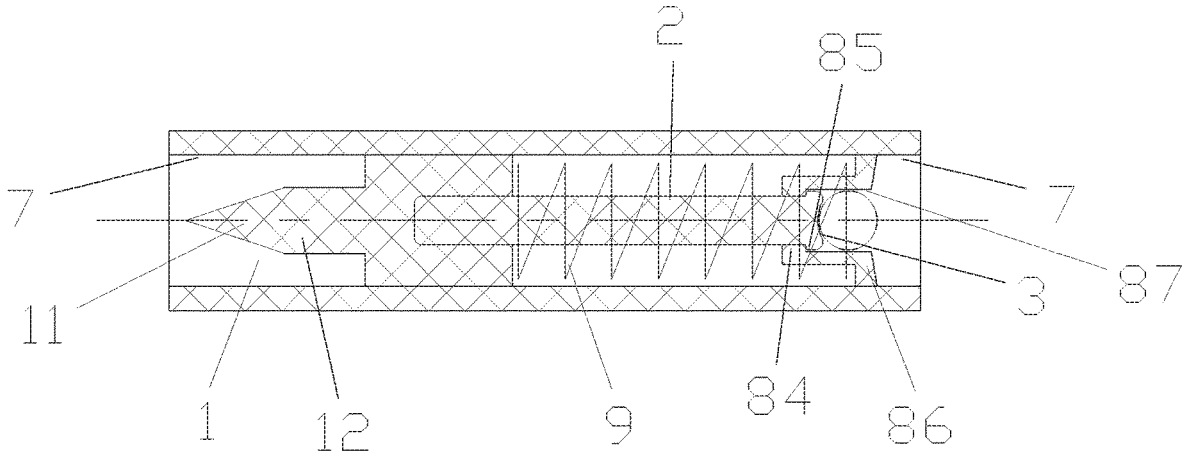
FIG. 10 is a sectional view of Embodiment 10 of the invention.

In a preferred solution, as shown in FIG. 10, an aromatic bead accommodating hole II 87 is formed in the middle of an aromatic bead positioning ring II 86, a stop ring 84 is arranged in the internal middle of the aromatic bead accommodating hole II, and a baffle ring 85 corresponding to the stop ring is arranged at the end of the push rod. The stop ring and the baffle ring prevent the aromatic bead positioning ring II from being pushed out of the cylindrical positioning sleeve by the compression spring, and the aromatic bead positioning ring II is compressed to retreat to the bottom of the cylindrical positioning sleeve when one aromatic bead is fed.

Besides, the invention is not limited to the above implementations, all other implementations capable of fulfilling the technical effects of the invention in the same way should also fall within the protection scope of the invention.

The invention claimed is:

1. An aromatic bead feeder for cigarette filters, comprising a conical part (1) and a push rod (2) directly or indirectly connected with the conical part;

wherein cylindrical positioning sleeves (7) matched with cigarette filters are arranged outside the conical part and the push rod, or a cylindrical positioning sleeve (7) matched with the cigarette filters is arranged outside the conical part or the push rod;

wherein an aromatic bead positioning ring (8) is arranged in the cylindrical positioning sleeve outside the push rod, has a middle provided with an aromatic bead accommodating hole (81), and is able to slide forwards and backwards in the cylindrical positioning sleeve, and the push rod is able to stretch into the aromatic bead accommodating hole.

2. The aromatic bead feeder for cigarette filters according to claim 1, wherein the conical part includes a front cone part (11) and a rear extension part (12).

3. The aromatic bead feeder for cigarette filters according to claim 1, wherein the conical part and the push rod are indirectly connected into a whole through a connection part and are respectively located at two ends of the connection part or located at one end of the connection part.

4. The aromatic bead feeder for cigarette filters according to claim 3, wherein the connection part is an accommodating part (4) provided with an accommodating cavity and an aromatic bead outlet (41), and a cover (42) capable of being opened or closed is arranged at the aromatic bead outlet (41).

5. The aromatic bead feeder for cigarette filters according to claim 4, wherein the accommodating part is a circular tube (44), the cover capable of being opened or closed is a rotatable sleeve ring (45) arranged on the circular tube and located at the aromatic bead outlet, and a through hole (46) capable of being rotated to correspond to the aromatic bead outlet is formed in the sleeve ring.

6. The aromatic bead feeder for cigarette filters according to claim 4, wherein the accommodating part is a square tube (47), and the cover capable of being opened or closed is a slidable cover plate (48) arranged on the square tube and located at the aromatic bead outlet.

7. The aromatic bead feeder for cigarette filters according to claim 4, wherein a magnetic sheet (43) is arranged at one internal end of the accommodating part, or magnetic sheets (43) are arranged at two internal ends of the accommodating part.

8. The aromatic bead feeder for cigarette filters according to claim 3, wherein the connection part is a chain (5) or a connection block (6).

9. The aromatic bead feeder for cigarette filters according to claim 1, wherein a compression spring (9) is arranged on an internal side of the aromatic bead positioning ring and abuts against an internal bottom of the cylindrical positioning sleeve.

10. The aromatic bead feeder for cigarette filters according to claim 9, wherein a clamping point (82) is arranged at an external edge of the aromatic bead positioning ring, and a clamping ring (83) corresponding to the clamping point is arranged at an end of the cylindrical positioning sleeve.

11. The aromatic bead feeder for cigarette filters according to claim 9, wherein a stop ring (84) is arranged in an internal middle of the aromatic bead accommodating hole, and a baffle ring (85) corresponding to the stop ring is arranged at an end of the push rod.

12. The aromatic bead feeder for cigarette filters according to claim 2, wherein cylindrical positioning sleeves (7) matched with cigarette filters are arranged outside the conical part and the push rod, or a cylindrical positioning sleeve (7) matched with the cigarette filters is arranged outside the conical part or the push rod.

13. The aromatic bead feeder for cigarette filters according to claim 12, wherein an aromatic bead positioning ring (8) is arranged in the cylindrical positioning sleeve outside the push rod, has a middle provided with an aromatic bead accommodating hole (81), and is able to slide forwards and backwards in the cylindrical positioning sleeve, and the push rod is able to stretch into the aromatic bead accommodating hole.

14. The aromatic bead feeder for cigarette filters according to claim 13, wherein a compression spring (9) is arranged on an internal side of the aromatic bead positioning ring and abuts against an internal bottom of the cylindrical positioning sleeve.

15. The aromatic bead feeder for cigarette filters according to claim 3, wherein cylindrical positioning sleeves (7) matched with cigarette filters are arranged outside the conical part and the push rod, or a cylindrical positioning sleeve (7) matched with the cigarette filters is arranged outside the conical part or the push rod.

16. The aromatic bead feeder for cigarette filters according to claim 15, wherein an aromatic bead positioning ring (8) is arranged in the cylindrical positioning sleeve outside the push rod, has a middle provided with an aromatic bead accommodating hole (81), and is able to slide forwards and backwards in the cylindrical positioning sleeve, and the push rod is able to stretch into the aromatic bead accommodating hole.

17. The aromatic bead feeder for cigarette filters according to claim 16, wherein a compression spring (9) is arranged on an internal side of the aromatic bead positioning ring and abuts against an internal bottom of the cylindrical positioning sleeve.

* * * * *